US006305203B1

(12) United States Patent
Yasui

(10) Patent No.: US 6,305,203 B1
(45) Date of Patent: Oct. 23, 2001

(54) CONTROLLING SUPERPLASTIC FORMING WITH GAS MASS FLOW METER

(75) Inventor: Ken K. Yasui, Huntington Beach, CA (US)

(73) Assignee: McDonnell Douglas Corporation, St. Louis, MO (US)

( * ) Notice: Subject to any disclaimer, the term of this patent is extended or adjusted under 35 U.S.C. 154(b) by 0 days.

(21) Appl. No.: 09/595,888

(22) Filed: Jun. 20, 2000

Related U.S. Application Data

(62) Division of application No. 08/980,366, filed on Nov. 28, 1997.

(51) Int. Cl.[7] ..... B21D 26/02

(52) U.S. Cl. ..... 72/60; 72/342.1; 72/709; 29/421.1

(58) Field of Search ..... 72/60, 38, 709, 72/342.1; 29/421.1; 264/516, 545; 425/387.1, 394, 395

(56) References Cited

U.S. PATENT DOCUMENTS

| | | | | |
|---|---|---|---|---|
| 4,233,829 | * | 11/1980 | Hamilton et al. | 72/38 |
| 4,487,213 | * | 12/1984 | Gates et al. | 137/2 |
| 4,708,008 | | 11/1987 | Yasui et al. | 72/60 |
| 4,833,768 | * | 5/1989 | Ecklund et al. | 72/60 |
| 4,901,552 | * | 2/1990 | Ginty et al. | 72/60 |
| 4,951,491 | * | 8/1990 | Lorenz | 72/60 |
| 5,129,248 | * | 7/1992 | Yasui | 72/60 |
| 5,309,747 | * | 5/1994 | Yasui | 72/60 |
| 5,419,170 | * | 5/1995 | Sanders et al. | 72/60 |
| 5,689,987 | * | 11/1997 | Yasui | 72/60 |
| 5,737,954 | * | 4/1998 | Yasui | 72/60 |
| 5,870,304 | * | 2/1999 | Yasui | 72/60 |

* cited by examiner

*Primary Examiner*—David Jones
(74) *Attorney, Agent, or Firm*—Westerlund, Powell, P.C.; Raymond H. J. Powell, Jr.; Robert A. Westerlund

(57) ABSTRACT

The forming time necessary to superplastically form an object from a metal sheet is estimated by empirical analysis. The required rate of gas mass flow into a forming cavity is then determined using either a nomograph composed of four interrelated graphs, or a single graph which requires the input of fewer variables than the nomograph. The present invention may also be used to form cells of multiple sheet panels from a stack of sheets. In the latter application, forming time necessary to complete forming of the cells from an interim point where the core sheet forming pressure and the die temperature are increased from interim levels to their final values is estimated by empirical analysis. A nomograph or single graph of the present invention then determines the gas mass flow rate necessary to safely and efficiently complete forming of the cells from the foregoing interim point. In both of the foregoing embodiments, the required gas mass flow rate, which is a target value, is maintained by regulating the forming pressure until the final forming pressure is reached.

12 Claims, 9 Drawing Sheets

CONTROLLING SUPERPLASTIC FORMING WITH GAS MASS FLOW METER

This application is a divisional application of Ser. No. 08/980,366 filed on Nov. 28, 1997.

FIELD OF THE INVENTION

This invention relates to the field of metal forming and, more particularly to the forming of objects from alloys which exhibit superplastic characteristics, by regulating the forming pressure during the superplastic forming process so that the forming gas flows into the forming die at a predetermined mass flow rate.

BACKGROUND OF THE INVENTION

When heated to a particular temperature range, certain alloys arc capable of undergoing enorinous plastic elongation, or strain, with uniform thinning throughout the full area of a metal sheet or blank. This characteristic, known as superplasticity. is used to form objects from such alloys by placing a metal sheet in a forming die containing a die cavity, heating the sheet to the desired temperature, and then applying a pressure differential to the respective sides of the sheet for a period of time. The pressure differential, known as the forming pressure, is obtained by introducing a pressurized inert gas into the sealed die on one side of the sheet, while the die cavity on the other side of the sheet contains an inert gas at a lower pressure, for example, atmospheric pressure. The forming pressure forms the heated metal sheet to the shape of the die cavity or the shape of a male die located in the die cavity.

Forming pressure and strain rate are related variables. Their relationship is affected by the superplasticity of the metal sheet, and by the geometry of the object to be formed. Using the critical assumption that the strain rate remains constant, a forming schedule, also called a pressure forming cycle, can be mathematically derived to provide the forming pressure as a function of forming time. The strain rate is empirically determined to be a value that is low enough to avoid rupturing the sheet during forming, yet high enough to form the desired object within a reasonable period.

An example of the foregoing approach is provided by Hamilton et al. in U.S. Pat. No. 4,233,829. As can be seen therein, the calculations necessary to derive the forming pressure versus time graph are complex and very time consuming, even for the simple geometry of a rectangular pan.

Hamilton et al. further disclose apparatus for automatically supplying the forming pressure called for by the pressure versus time graph to the forming die cavity. Others have used similar methods of mathematical analysis to produce graphs of forming pressure versus time, and then used other means to adjust the forming pressure in accordance with their respective graphs.

The problem inherent to the foregoing approaches is that any mathematical model used to obtain a graph of forming pressure versus time is only an approximation because the assumed value for the strain rate used in the model cannot be determined with any degree of certainty and, furthermore, the strain rate is assumed to remain constant whereas, in fact, it varies throughout the forming cycle as well as spatially across the forming sheet.

The relationship between the forming stress, $\sigma$, and strain rate, $\dot{\epsilon}$, is expressed by the following equation:

$$\sigma = K\dot{\epsilon}^m$$

wherein:

K is a forming constant; and m is the strain rate sensitivity.

A critical inaccuracy in the foregoing assumptions arises from the inherent nature of the strain rate sensitivity, m, which has an exponential effect in the relationship between stress, $\sigma$, and strain rate, $\dot{\epsilon}$. The strain rate sensitivity, m, is empirically known for most metallic alloys, or can be obtained from a forming test. However, m varies with the temperature and microstructure of the sheet, as well as with the forming stress, $\sigma$, and thus changes throughout the forming process. The empirical value for m is thus an approximation for the entire forming process, and the reliability of the pressure versus time graph will suffer as m varies due to the aforementioned factors.

The foregoing mathematical approaches also assume that the strain rate is the same over the entire surface of the sheet, whereas it actually varies from point to point over the sheet due to the sheet's changing geometry during forming, variations in the sheet's thickness, and temperature gradients. Their accuracy is also adversely affected by slippage of the sheet after it comes into contact with the interior surface of the die cavity. In addition, mathematical models fail to account for differences in superplasticity that inevitably occur among different sheets of the same alloy, caused by innate variations in the production process.

In summary, the assumptions and approximations necessary to the mathematical analysis for deriving the forming pressure as a function of time, introduce errors which adversely affect the reliability of the relationship, especially as the geometry of the object becomes more complex. This inaccuracy causes a difference between the actual position of the forming sheet and its predicted position. The forming pressure versus time graph does not correct for such deviations, with the result that an inappropriate forming pressure may be applied. Rupture may be the result.

Efforts have been made to monitor the deformation of the sheet so that the forming pressure can be adjusted to take into account a deviation of the actual position of the forming sheet from the predicted position and avoid rupture due to this problem. For example, in U.S. Pat. No. 4,489,579, Daime et al. show a hollow tube slideably projecting into the die cavity and having one end in contact with the sheet in order to measure the distortion of the sheet. Electrical monitoring devices are situated at each recess angle of the die cavity to inform of the arrival of the sheet. Further, Japanese Patent No. 1-210130 issued to Hisada shows a touch sensor slideably projecting into the die cavity. The sensor comes into contact at only one point on the sheet, and thus would not, be able to indicate how the sheet is forming in corners or other recesses in the die cavity.

Both of the foregoing approaches require breaching the die cavity, and thus add mechanical complexity and expense to the forming die. Furthermore, both require having a sensor in contact with the forming sheet. This will result in the area of the sheet in contact with the sensor being prevented from forming normally, thus affecting the strain rate and causing a discontinuity in material thickness in the formed object between the area that was in contact with the sensor and the adjacent area.

In U.S. Pat. No. 5,007,265, Mahoney et al. use a video camera to view reference marks on the sheet and thereby monitor its strain. The device described therein thus requires a special forming die having a window to allow observation of the forming sheet. Such a special forming die would clearly be more expensive to fabricate than a conventional forming die. A further drawback is that the sheet must be continually observed by the operator during the forming process, and therefore the use of the described apparatus does not lend itself to automation and the attendant savings in production cost.

Another approach to controlling superplastic forming is shown by Yasui in U.S. Pat. No. 5,129,248. The apparatus and method shown therein control the strain rate by measuring and regulating the flow rate of gas mass flowing into the forming die and displacing the sheet being formed. This is an advance over controlling forming by regulating pressure according to a predetermined relationship between pressure and time because it does not rely on the assumption that an empirically determined strain rate remains constant during the forming process and over the entire forming sheet. The possibility of rupture inherent in the use of a pressure versus time graph is thus avoided.

In U.S. Pat. No. 4,708,008, Yasui et al. show an apparatus for controlling the superplastic forming of a sheet by continuously monitoring the height of liquid in a manometer fluidly communicating with the gas being displaced and exhausted from a forming die cavity during forming, in conjunction with regulating the forming pressure responsive to the height of the liquid on the manometer. Beforming is begun, the use of the foregoing device requires an empirical or mathematical analysis to determine the relationship between the forming pressure and the location of the sheet as it is forming. The relationship between the forming progress of the sheet and the displaced volume of the exhaust gas is then determined.

The displaced volume is then converted into exhaust pressure, and the exhaust pressure is converted into the height of liquid in a manometer fluidly communicating with the exhaust gas. The foregoing relationships are used to drive the relationship between forming pressure and the height of liquid in the manometer, which is the relationship used to guide the forming process. Although this apparatus is useful for testing the forming of cylindrical shapes, the foregoing analyses can be complex.

Based on the foregoing, it can be appreciated that there presently exists a need for a method and apparatus to control superplastic forming which overcomes the above described disadvantages and shortcomings of the prior art. The present invention provides an apparatus in conjunction with a reliable yet simple method for regulating superplastic forming, and in so doing fulfills this need in the art.

SUMMARY OF THE INVENTION

Given the shape and volume of an object to be superplastically formed from a metal sheet, the forming time is estimated by empirical analysis. The rate of gas mass flow into a forming cavity required to reliably and efficiently form the object is then determined using either a nomograph composed of four interrelated graphs, or a single graph which requires the input of fewer variables than the nomograph. Although the single graph is less precise than the nomograph, it will provide accuracy sufficient for many applications.

The present invention may also be used to form cells of multiple sheet panels from a stack of sheets. In the latter application, forming time necessary to complete forming of the cells from an interim point where the core sheet forming pressure and the die temperature are increased from interim levels to their respective final values is estimated by empirical analysis. A nomograph or single graph of the present invention then determines the gas mass flow rate necessary to reliably and efficiently complete forming of the cells from the foregoing interim point.

In both of the foregoing embodiments, the required gas mass flow rate, which is a target value, is maintained by regulating the forming pressure during the forming cycle, until the final forming pressure is reached.

DETAILED DESCRIPTION OF PREFERRED EMBODIMENTS

Figure 1:
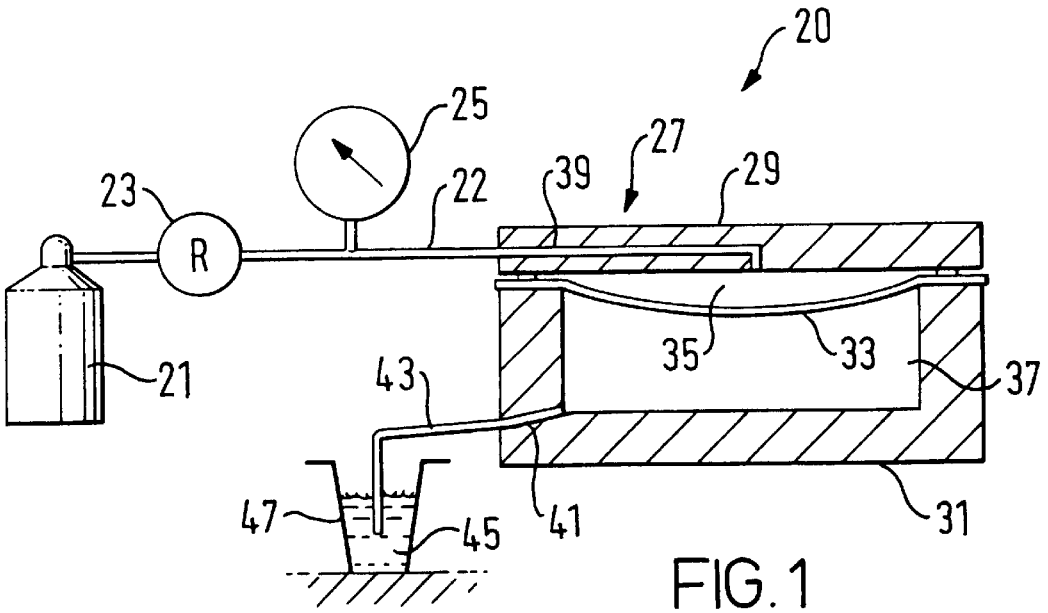
FIG. 1 PRIOR ART
FIG. 1 is a schematic drawing of a superplastic forming apparatus of the prior art.

FIG. 1 is a schematic of a simple prior art superplastic forming apparatus 20, which controls superplastic forming by regulating the forming pressure as a function of time. Apparatus 20 includes gas bottle 21, gas input line 22, pressure regulator 23, pressure gage 25, and forming die 27. Bottle 21 contains a pressurized inert gas, typically argon gas. This is known as the forming gas. Input line 22 fluidly communicates bottle 21, pressure regulator 23, pressure gage 25, and forming die 27. Forming die 27 is comprised of lid 29 and bottom section 31.

Metal sheet 33 is rigidly positioned in forming die 27 by having its periphery tightly compressed in between lid 29 and bottom section 31. Volume 35 is contained by sheet 33 and lid 29. Input port 39 is a passageway through lid 29 providing for fluid communication between input line 22 and volume 35. Bottle 21 thus fluidly communicates with volume 35.

Forming cavity 37 is a volume enclosed by bottom section 31 and sheet 33. Volume 35 and cavity 37 do not fluidly communicate. Although not used in this example, cavity 37 could contain a male die whose shape would be determined by the shape of the object to be formed.

Exhaust port 41 is a passageway through bottom section 31, and fluidly communicates with cavity 37. Initially, exhaust port 41 also fluidly communicates with bottle 21 to fill cavity 37 with inert gas at atmospheric pressure. However, before the forming cycle is commenced, exhaust port 41 is connected to exhaust line 43, as shown in FIG. 1. Exhaust line 43 fluidly communicates with water 45 contained in open beaker 47.

Volume 35 is at its minimum volume before the forming cycle is begun, and expands throughout the forming cycle, while cavity 37 concomitantly decreases. As cavity 37 decreases with time, the inert gas contained therein exhausts through water 45 and into the ambient atmosphere. The insertion of the end of exhaust line 43 in water 45 allows the pressure in cavity 37 to remain at atmospheric pressure throughout the forming cycle. More importantly, as metal sheet 33 is typically susceptible to oxidation at the elevated temperatures required for superplastic forming, the foregoing configuration prevents air from entering cavity 37 and oxidizing sheet 33.

The forming pressure is equal to the pressure of the inert gas in volume 35. Pressure gage 25 measures the forming pressure acting against sheet 33.

Figure 2:
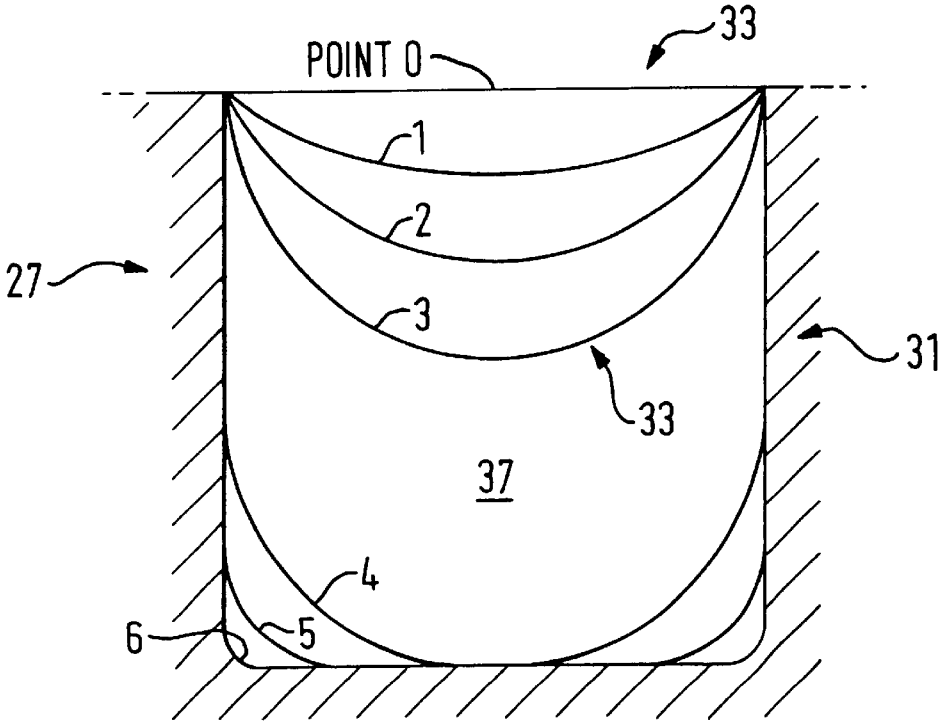
FIG. 2 PRIOR ART
FIG. 2 is a schematic drawing of the die cavity of the prior art superplastic forming apparatus of FIG. 1, and particularly shows the various stages of the forming into a deep cup therein.
Figure 3:
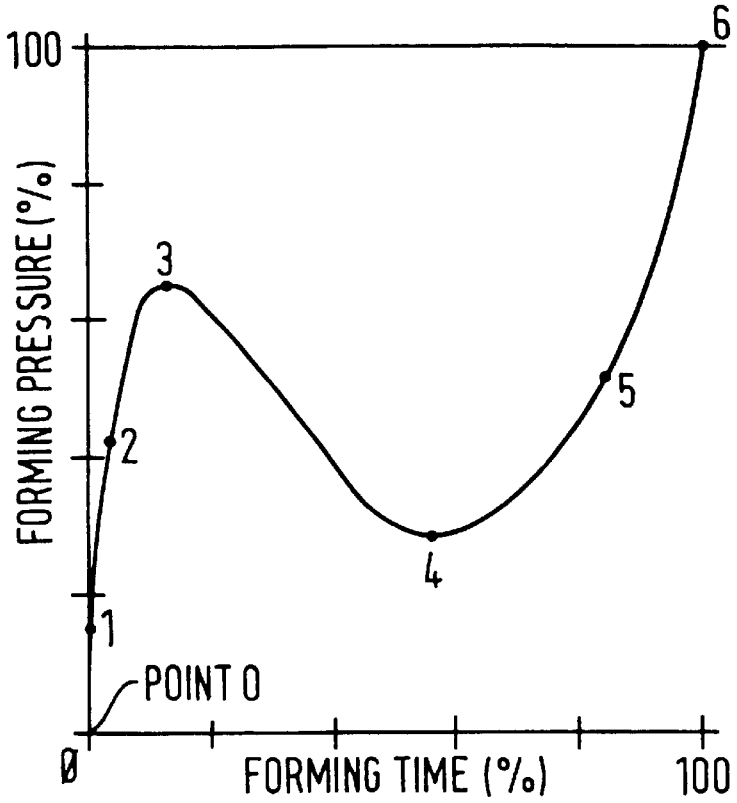
FIG. 3 PRIOR ART
FIG. 3 is a graph showing the theoretical relationship of forming pressure versus time for the prior art superplastic forming of the deep cup shown in FIG. 2.

The problems inherent to controlling superplastic forming by regulating pressure as a function of time are best explained by means of the forming example illustrated in FIGS. 2 and 3. FIG. 2 a schematic drawing of cavity 37 of forming die 27 of prior art superplastic forming apparatus 20, and particularly shows the various stages of the forming of a deep cup therein from flat sheet 33. A deep cup has a ratio of its depth to its radius that is greater than one. FIG. 3 is a graph showing the theoretical relationship of forming pressure versus time for the superplastic forming of the deep cup shown in FIG. 2.

To facilitate an understanding of FIGS. 2 and 3, one must bear in mind that in its original state, sheet 33 is flat, thus having an infinite radius of curvature. As sheet 33 strains, its radius of curvature decreases and, with the decreased radius, the forming pressure required to maintain a constant strain rate increases. However, as the sheet strains it thins, and forming pressure required to obtain a chant strain rate decreases.

The beginning, flat configuration of sheet 33 is shown as point 0 in FIGS. 2 and 3. As the forming begins, the sheet thins and spherically expands to a slight. radius of curvature, as indicated by point 1. Through point 1 the radius of curvature is decreasing at a rate which affects the forming pressure more than the effect of the decreasing thickness, and thus the forming pressure required to maintain a constant strain rate is increasing.

Through point 2 the radius of curvature continues to decrease at a rate which affects the forming pressure more than the effect of the decreasing thickness, and so the required forming pressure continues to increase. At point 3, sheet 33 forms a hemisphere. From point 3 to point 4, where the center of sheet 33 first touches the bottom of forming cavity 37, the radius of curvature remains constant. As the thickness of sheet 33 continues to decrease, the required forming pressure also decreases thereafter until reaching point 4.

After contacting the bottom of forming cavity 37 (point 4), sheet 33 begins to form into the corner of forming cavity 37, with the result that the radius of curvature again decreases at a rate which affects the forming pressure more than the effect of the decreasing thickness of sheet 33. The required forming pressure thus forms a local minimum at point 4, and thereafter increases as the comer is being formed at point 5. The pressure continues to increase until the corner is formed against the die radius at point 6 and the forming cycle is completed.

As previously discussed, among other assumptions, FIGS. 2 and 3 assume that the strain rate remains constant throughout the forming cycle. Though actual forming will approximate the illustrated example under this condition, there are two modes which may compound the previously discussed inaccuracies inherent in the assumptions used to derive the pressure versus time relationship, and possibly lead to an excessive strain rate resulting in rupture of the sheet: faster forming and slower forming, relative to the assumed constant strain rate.

In the former, the sheet expands faster than anticipated due to the aforementioned inaccuracies. Sheet 33 would thus enter the constant radius zone between points 3 and 4 of FIG. 2 before anticipated and thus during the period when, although the required pressure is decreasing, the pressure being applied pursuant the theoretical forming pressure versus time graph is being increased until the local maximum is reached at point 3 of FIG. 3. The forming pressure thus becomes increasingly higher than the pressure necessary to produce the desired strain rate, resulting in a strain rate which may exceed the rate that sheet 33 can withstand. In an extreme case, sheet 33 may have a strain rate so high that it ruptures even before the forming pressure reaches its local maximum at point 3 of FIG. 3.

If rupture has not occurred by the time point 3 is reached on the pressure versus time plot of FIG. 3, the excess between the actual forming pressure (as called for by the forming pressure versus time plot of FIG. 3) and the pressure necessary to produce the desired constant strain rate will continue to increase because the higher than anticipated strain rate will cause thinning to occur at a greater rate than would normally be the case, thus further reducing the required forming pressure and concomitantly increasing the strain rate. Rupture may occur at any time until sheet 33 touches the bottom of forming cavity 37 and the required forming pressure begins to increase.

The slower forming mode occurs when sheet 33 forms more slowly than anticipated. The local maximum for the forming pressure occurring at point 3 of FIG. 3 thus occurs before sheet 33 actually reaches point 3 in FIG. 2. The forming pressure is thus decreased early, before sheet 33 enters the constant radius of curvature zone between points 3 and 4 of FIG. 2. The result is that the forming lags even further behind the positions anticipated by the forming pressure versus time plot of FIG. 3.

The problem arises when the forming pressure versus time plot reaches point 4 and the forming pressure is rapidly increased. At that juncture, sheet 33 will probably lie between points 2 and 3 or between points 3 and 4 of FIG. 2. In the former case, the increased forming pressure will cause sheet 33 to more rapidly strain and quickly enter the thinning thickness zone lying between points 3 and 4 of FIG. 2.

However, regardless of whether sheet 33 subsequently strains into the zone lying, between points 3 and 4 or is already there by the time point 4 is reached on the forming pressure versus time plot of FIG. 3, the increasing forming pressure called for by the forming pressure versus time plot of FIG. 3 results in a drastically increased strain rate in the zone when the thinning thickness and constant radius of curvature of sheet 33 calls for decreasing the forming pressure. The increasing differential between the actual forming pressure and the pressure required to maintain the desired constant strain rate causes an increase in the strain rate, until either sheet 33 ruptures or touches the bottom of forming cavity 37 and the required forming pressure begins to increase.

A further drawback to the use of a forming pressure versus time graph is that if the forming must be stopped for any reason, such as a malfunction of equipment, it is impossible to determine how much further the strain will have progressed while the forming pressure was held constant, or even reduced, during the interruption. Continuing the forming cycle after an interruption thus increases the risk of rupture.

Figure 4:
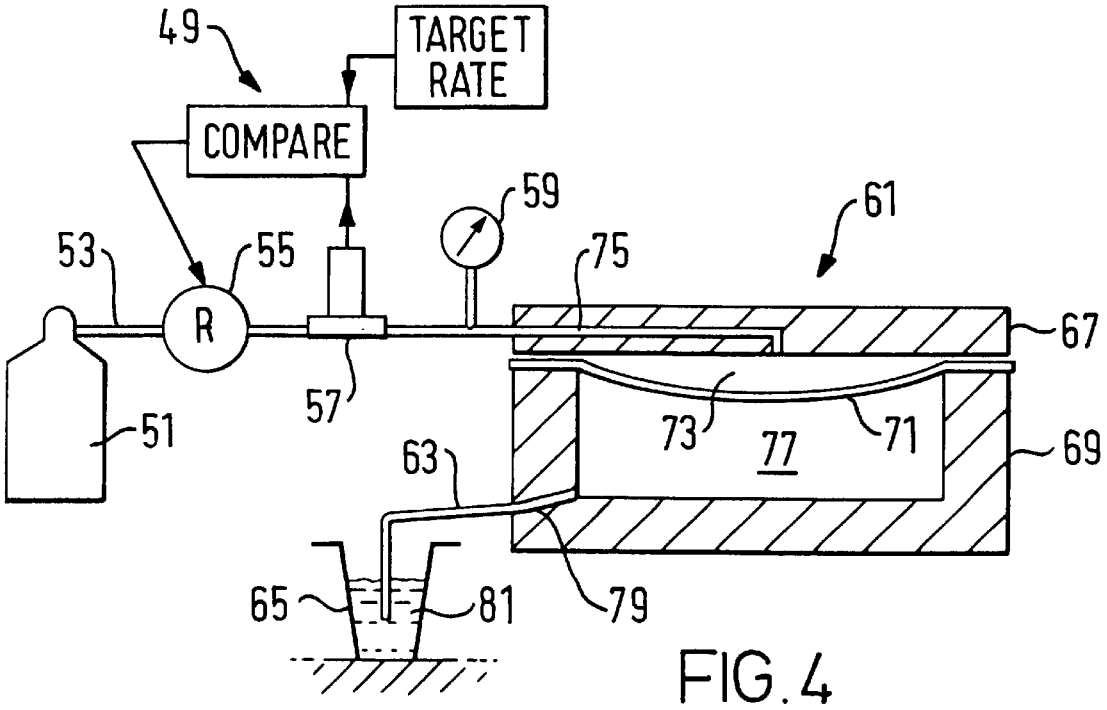
FIG. 4 is a schematic drawing of a superplastic forming apparatus of the present invention.

A FIG. 4 is a schematic drawing of superplastic forming apparatus 49, a preferred embodiment of the present invention. Apparatus 49 includes gas bottle 51, input line 53, pressure regulator 55, gas mass flow meter 57, pressure gage 59, forming die 61, exhaust line 63, and beaker 65. Forming die 61 is located inside of a furnace, such as a hot press, autoclave or vacuum furnace. The details of such furnaces are well known to those skilled in the superplastic forming art, and are not shown in the drawing. Bottle 51 contains a pressurized inert gas, preferably argon gas.

Forming die 61 is comprised of lid 67 and bottom section 69. Metal sheet 71 is rigidly positioned in forming die 61 by having its periphery tightly compressed in between lid 67 and bottom section 69. Variable volume 73 is enclosed between lid 67 and sheet 71. Input port 75 is a passageway through lid 67, fluidly communicating volume 73 and input line 53. Input line 53 fluidly communicates bottle 51, pressure regulator 55, gas mass flow meter 57, pressure gage 59, and input port 75. Volume 73 thus fluidly communicates with bottle 51.

Forming cavity 77 is a volume enclosed by bottom section 69 and sheet 71. Volume 73 and cavity 77 do not fluidly communicate. Although not shown in this embodiment, cavity 77 could contain a male die having a shape determined by the shape of the object to be formed Exhaust port 79 is a passageway through bottom section 69, fluidly communicating cavity 77 and exhaust line 63. Open beaker 65 contains water 81. Exhaust line 63 fluidly communicates exhaust port 79 and water 81. Thus, cavity 77 fluidly communicates with water 81.

Initially, exhaust port 79 fluidly communicates with bottle 51 to fill forming cavity 77 with inert gas at atmospheric pressure. However, before the forming cycle is commenced, exhaust port 79 is connected to exhaust line 63, as shown in FIG. 4.

Volume 73 is at its minimum volume before the forming cycle is begun, and expands throughout the forming cycle, while forming cavity 77 concomitantly decreases. As cavity 77 decreases with time, the inert gas contained therein exhausts through water 81 and into the ambient atmosphere. The insertion of the end of exhaust line 63 in water 81 allows the pressure in cavity 77 to remain at atmospheric pressure throughout the forming cycle. More importantly, as the metal of sheet 71 is typically susceptible to oxidation at the elevated temperatures required for superplastic forming, the foregoing configuration prevents air from entering cavity 77 and oxidizing sheet 71.

The present invention maintains a constant gas mass flow rate into variable volume 73 by adjusting the forming pressure by means of pressure regulator 55. The forming pressure is not adjusted to conform to a pressure versus time relationship as in the prior art, but rather is adjusted solely to maintain the gas mass flow rate at a predetermined target value. It has been found that the present invention thereby significantly reduces the occurrence of rupture due to slower forming or faster forming in comparison to the prior art because, when either of the foregoing occur, the present invention will automatically compensate and ensure a relatively even strain rate.

More particularly, if faster forming occurs, the gas mass flow rate indicated by gas mass flow meter 57 will increase above the target rate. Pressure regulator 55 would then be used to decrease the forming pressure and, concomitantly, the mass flow rate, until the predetermined target gas mass flow rate was reached. A reduction in the forming pressure would decrease the strain rate, thereby compensating for the faster forming problem. If slower forming occurs, the gas mass flow rate will decrease below the target rate. In this event, pressure regulator 55 would be used to increase the forming pressure and, concomitantly, the mass flow rate, until the target rate was reached. An increase in the forming pressure would increase the strain rate, thereby compensating for the slower forming problem.

Since monitoring gas mass flow meter 57 allows the artisan to know the progress of the forming process, varying the gas mass flow rate by adjusting pressure regulator 55 is also possible.

The gas mass flow rate is determined using a nomograph of the present invention shown in FIGS. 5A, 5B, 5C, and 5D. The nomograph was derived using the ideal gas law, which is valid for a forming gas such as argon gas for forming pressures up to 1000 pounds per square inch.

The following example will facilitate an understanding of the foregoing nomograph and the present invention. The forming parameters are as follows:

volume of forming cavity 77=500 cubic inches final forming temperature (temperature in forming die 61)=1650° F.

line and gage volume (the volume contained within input line 53 between gas mass flow meter 57 and port 75, including pressure gage 59)=3 cubic inches final forming pressure=100 pounds per square inch gage (psig)

forming time=20 minutes

The final forming pressure is estimated based on empirical knowledge and the thickness of sheet 71, which is 0.050 inches in this example. For both forming pressure and forming temperature, the final value is that which is intended to occur upon completion of the forming time. The forming time is empirically estimated based on the geometry of the object to be formed and the properties of the alloy composing sheet 71. Ti-6Al-4V is the titanium alloy used in this example.

Figures 5A, 5B:
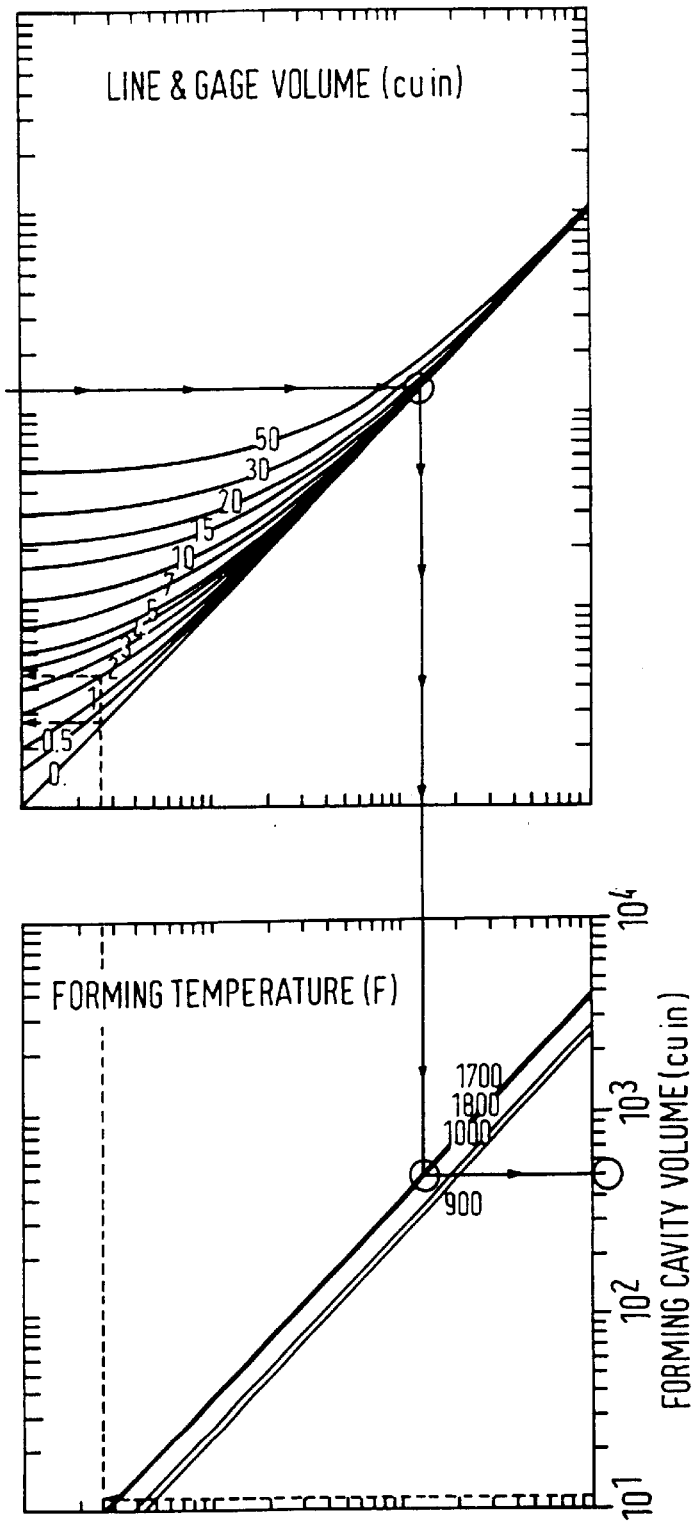
FIGS. 5A, 5B, 5C and 5D are four interrelated graphs composing a nomograph from which the gas mass flow rate of the present invention can be determined, and also including lines used in conjunction with an example illustrating the use of the apparatus of FIG. 4.

Beginning with the lower right graph composing FIG. 5A, the forming cavity volume, 500 cubic inches, is first selected on the vertical scale. Next, the intersection of a horizontal line drawn from the foregoing value, with the diagonal line for the final forming temperature of 1650° F. is obtained. A vertical line is then drawn from the foregoing intersection into the graph composing FIG. 5B, until it intersects the curved line representing the line and gage volume of 3 cubic inches. As may be discerned, the effect of the line and gage volume decreases as the forming cavity volume increases.

Figures 5C, 5D:
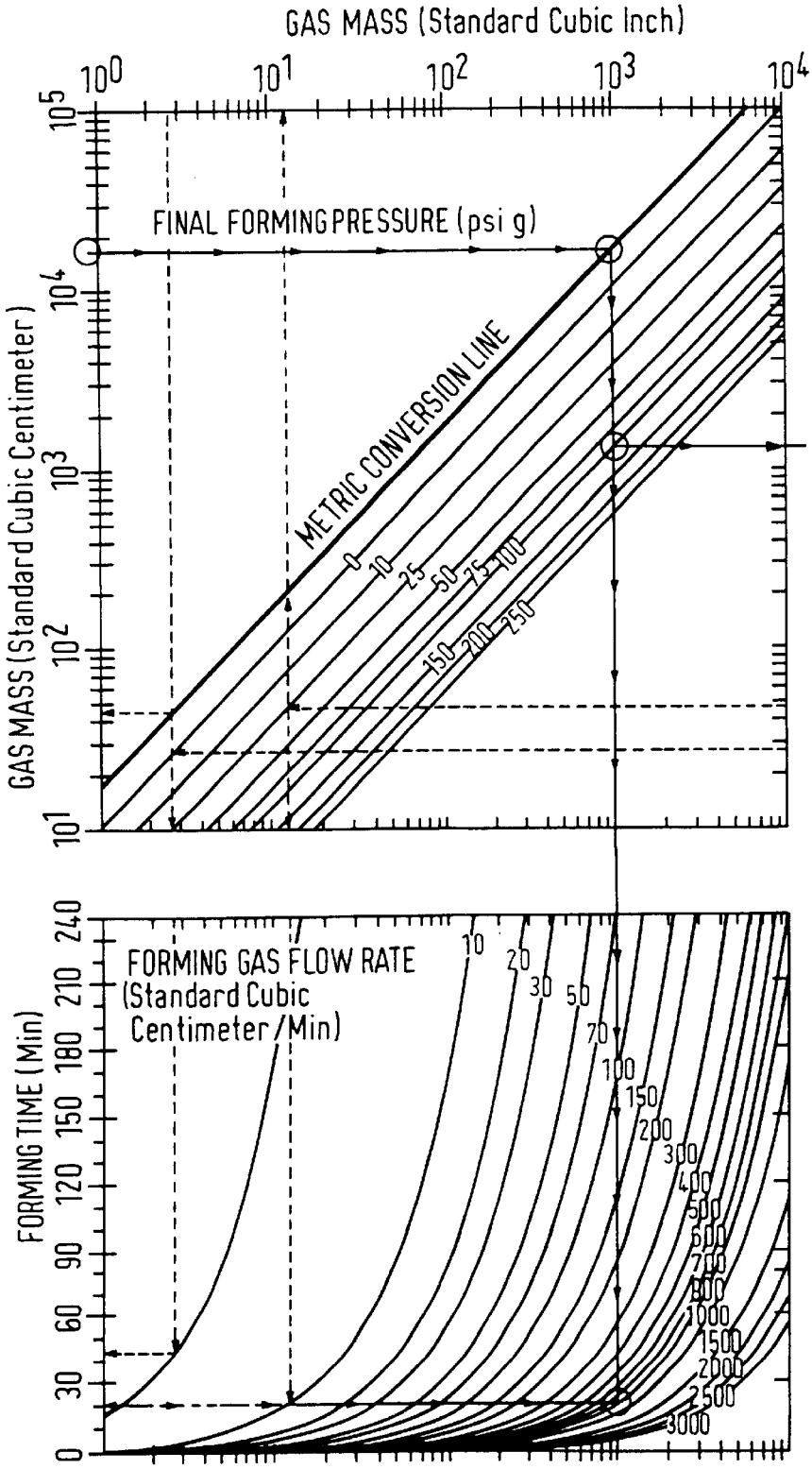

A horizontal line is next drawn from the foregoing intersection into the graph composing FIG. 5C, until it intersects the diagonal line representing the final forming pressure of 100 psig. Then a vertical line is drawn from the foregoing intersection downward into the graph composing FIG. 5D.

The forming time of 20 minutes is found on the vertical scale of graph composing FIG. 5D, and a horizontal line extended therefrom to the right until it intersects the previously determined line extending downward from FIG. 5C. The plurality of curved lines in FIG. 5D represent various forming gas mass flow rates. The aforementioned intersection occurs at a gas mass flow rate of 800 standard cubic centimeters per minute (scc/min).

In order to superplastically form the desired object in approximately 20 minutes, pressure regulator 55 should be continually adjusted to maintain a target gas mass flow rate of 800 scc/min on gas mass flow meter 57. Pressure regulator 55 may be manually adjusted in conjunction with monitoring gas mass flow meter 57, or automatically adjusted using a feedback loop as indicated in FIG. 4. The feedback loop includes means for continuously comparing the actual gas mass flow rate with the target gas mass flow rate and determining the difference between these two rates and generating a signal which is a function of the difference. This signal is transmitted to the pressure regulator 55, which is responsive to this signal. The target rate is determined by the nomograph of FIGS. 5A–5D.

The accuracy of the variables used in obtaining the gas mass flow rate from the nomograph will not affect the success of forming, but rather the accuracy of the predicted forming time in comparison to the forming time actually needed when using the target gas mass flow rate. The objective is to reach the predetermined final forming pressure. If the target gas mass flow rate is accurate, then the final forming pressure will equal the predetermined final forming pressure at the conclusion of the forming time. If the target gas mass flow rate is too high, then the forming pressure will reach the predetermined final forming pressure before the end of the forming time. If the target gas mass flow rate is too low, it will take longer than the forming time for the forming pressure to reach the predetermined final forming pressure.

Figure 6:
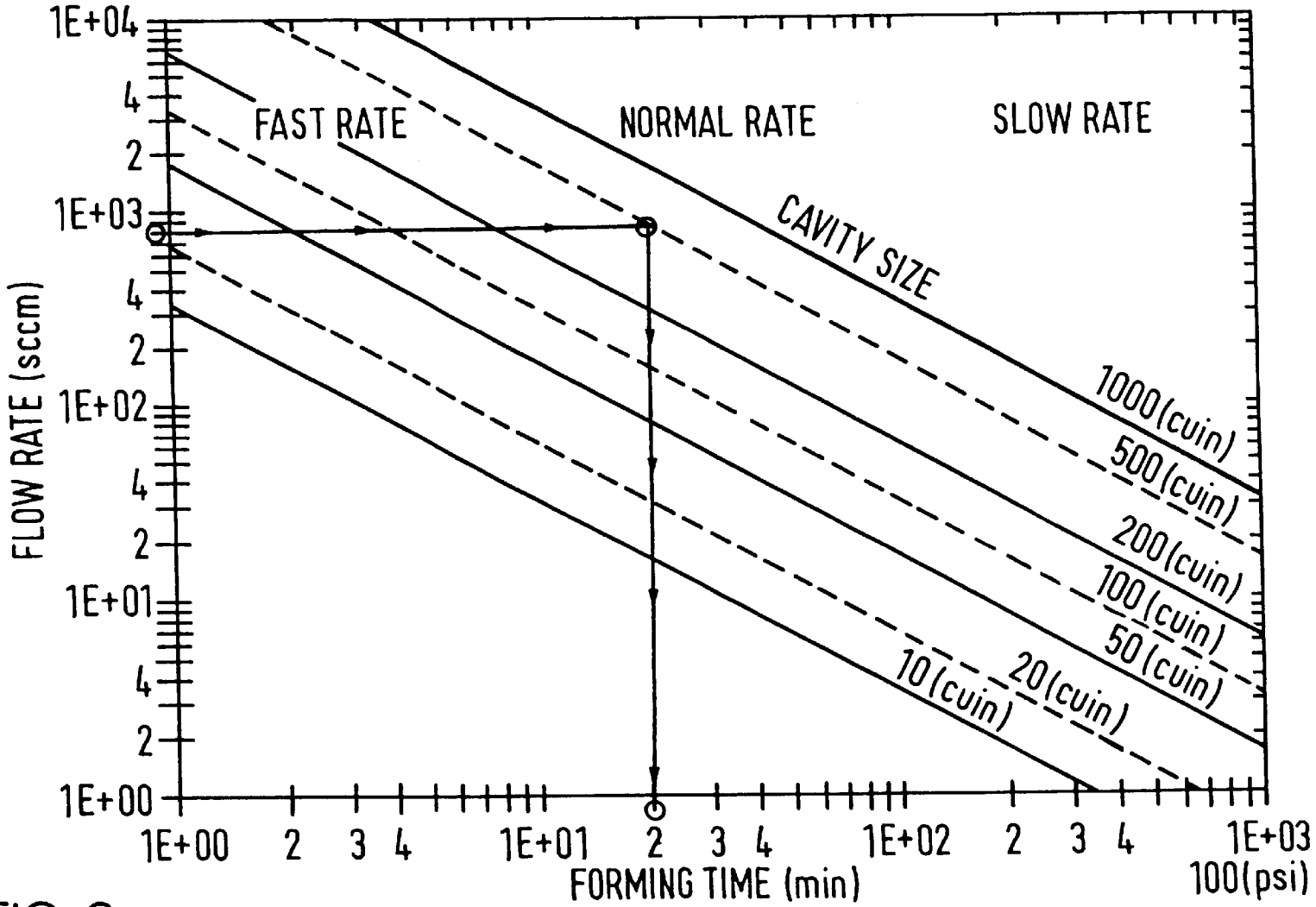
FIG. 6 is a graph for determining the gas mass flow rate of the present invention which requires fewer input variables than the nomograph of FIGS. 5A, 5B, 5C and 5D.

FIG. 6 is a graph of the present invention which provides the constant input gas mass flow rate, i.e., the target rate, necessary for successful superplastic forming in superplastic forming apparatus 49. Its use requires fewer input parameters than the nomograph of the FIGS. 5A–5D. More particularly, to use the graph of FIG. 6, the user need input only the forming time and the volume of forming cavity 77.

The graph of FIG. 6 was derived using the same mathematical analysis used to obtain the foregoing nomograph, but with three simplifying assumptions: that the line and gage volume is negligible, that is, no more than 10% of the volume of forming cavity 77; that the final forming temperature is 1650° F.±50° F.; and that the final forming pressure is 100 psig. The graph of FIG. 6 can also be derived (using the foregoing assumptions) from the nomograph of FIGS. 5A, 5B, 5C, and 5D. Simplified graphs for different final forming pressures can be similarly obtained so long as the foregoing assumptions regarding line and gage volume and final forming temperature are valid.

Returning to the previously discussed example, the simplified graph of FIG. 6 indicates that for a forming time of 20 minutes and a forming cavity volume of 500 cubic inches, a gas mass flow rate of 800 scc/min will ensure superplastic forming of the desired object without rupture and at close to the estimated forming time. Any inaccuracy in the simplified graphical solution provided by FIG. 6 will result in a gas mass flow rate that is lower than the maximum rate that could be safely used, and will result in an actual forming time greater than the estimated time. Thus, the only consequence might be that the actual forming time will exceed the estimated forming time.

Figure 7:
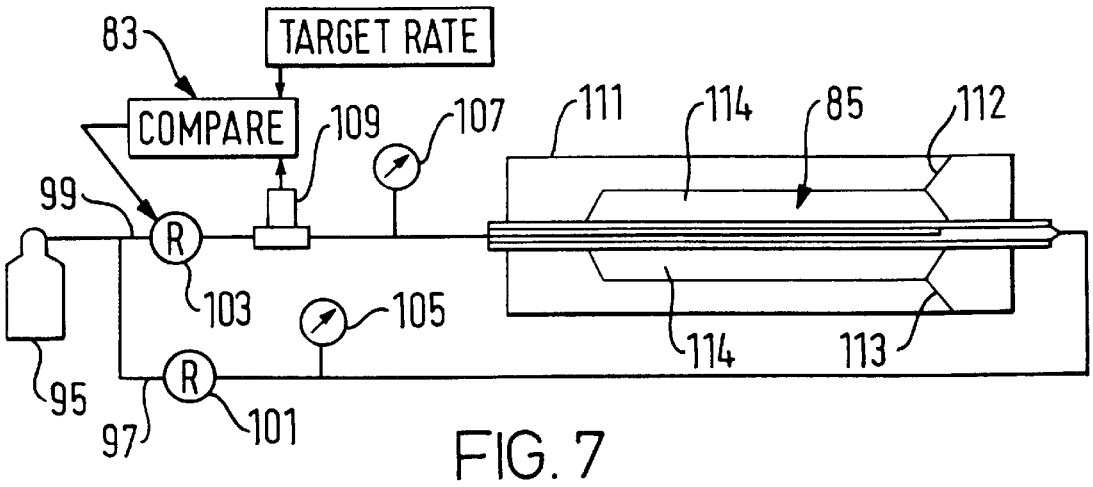
FIG. 7 is a schematic drawing of another embodiment of the superplastic forming apparatus of the present invention adapted for superplastically forming objects from stacked multiple sheets.

FIG. 7 schematically shows superplastic forming apparatus 83, an apparatus of the present invention adapted for superplastically forming objects from stacked multiple sheets. In particular, apparatus 83 is intended to form structures having internal cells An example using four stacked sheets will illustrate the use of the present invention for such an application.

The apparatus 83 may include a feedback loop from a gas mass flow meter 109 to a pressure regulator 103, as indicated, for controlling gas mass flow.

Figure 8:
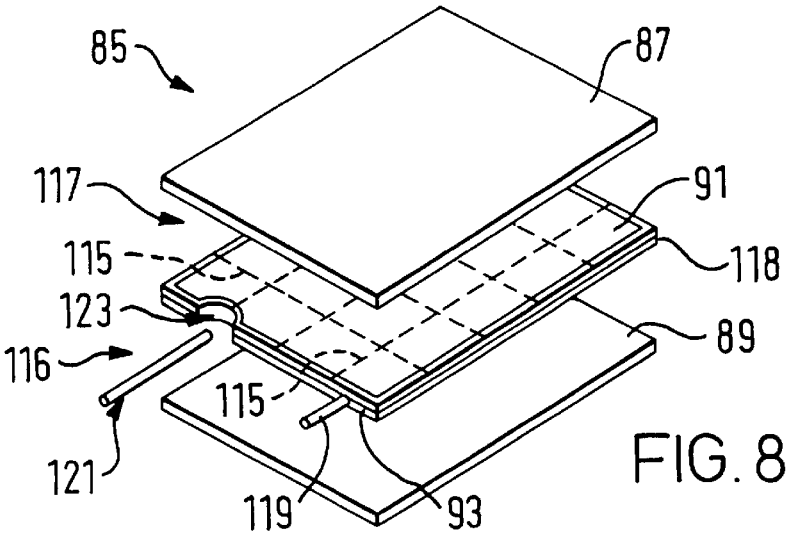
FIG. 8 is an exploded view of the four sheet stack to be superplastically formed into cells of multiple sheet panels by the apparatus of FIG. 7.

As particularly shown in FIG. 8, sheet stack 85 is composed of face sheets 87 and 89, and core sheets 91 and 93. In this example, it is assumed that the sheets are composed of a titanium alloy. The results are typical for superplastic forming using an alloy from this family, though they may differ depending upon the particular alloy used. Face sheets 87 and 89 are shown exploded apart from core sheets 91 and 93 to facilitate understanding.

Apparatus 83 is comprised of gas bottle 95, gas lines 97 and 99, pressure regulators 101 and 103, pressure gages 105 and 107, gas mass flow meter 109, and forming die 111. Forming die 111 is located inside of a furnace, such as a hot press or autoclave. The details of such furnaces are well known to those skilled in the superplastic forming art, and are not shown in FIG. 7. Exhaust ports 112 and 113 are passageways through forming die 111.

Stack 85 is situated inside of forming die 111. Cavity 114 is the volume contained between face sheets 87 and 89, and the interior walls of die 111 Cavity 114 is filled with argon gas at ambient atmospheric pressure before the superplastic forming process is begun. Core sheets 91 and 93 are attached to each other by roll spot welds 115. Face sheets 87 and 89 abut, but are not fastened to, core sheets 91 and 93, respectively.

Space 116 is the volume contained between core sheet 93 and face sheet 89. Space 117 is the volume contained between core sheet 91 and face sheet 87. The pressure in space 116 and 117 is known as the face sheet pressure. Core space 118 is the volume contained between core sheets 91 and 93. The pressure in core space 118 is known as the core sheet pressure. Spaces 116 and 117 and core space 118 all increase during the superplastic forming process.

Gas bottle 95 contains a pressurized inert gas, preferably argon gas. Gas bottle 95 fluidly communicates through gas line 97 with pressure regulator 101, pressure gage 105, space 116, and space 117. Gas bottle 95 also fluidly communicates through gas line 99 with pressure regulator 103, gas mass flow meter 109, pressure gage 107, and core space 118. As particularly illustrated in FIG. 8, gas line 99 fluidly communicates with core space 118 through core port 119. The pressurized argon gas passes through the spaces between roll spot welds 115, and thus fluidly communicates with all of core space 118. Gas line 97 fluidly communicates with spaces 116 and 117 through port 121. Port 121 is welded to stack 85 at cutout 123.

Figure 9:
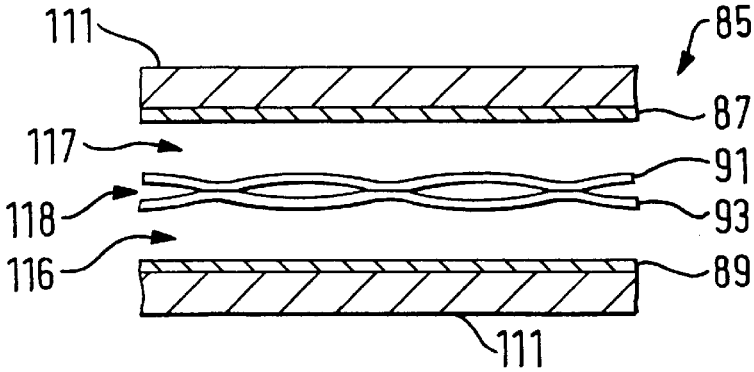
FIG. 9 is a fragmented section view of the die of the apparatus of FIG. 7, particularly showing the configuration of the sheets just after the core sheets have begun to separate.
Figure 11:
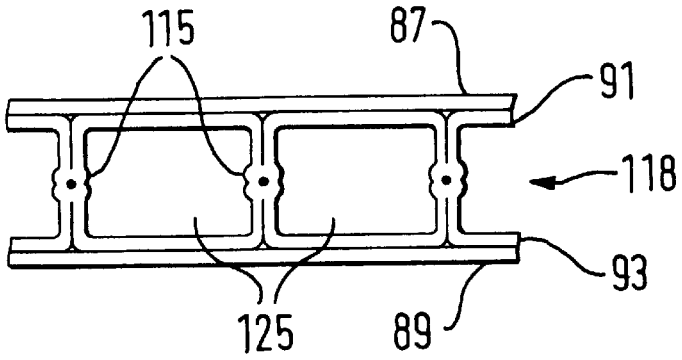
FIG. 11 is a fragmented section view of the cells formed by the apparatus of FIG. 7.

Gas is supplied through the line 99 to pressurize the space 118 shown in FIG. 9 to configure the core sheets 91 and 93 to the final geometry shown in FIG. 11. Accordingly, the gas mass flow meter 109 is included in the line 99. Gas is supplied through the line 97 to pressurize the spaces 116 and 117 to expand the face sheets 87 and 89 against the forming dies 111.

To begin the process, forming die 11 is heated. The core sheet and face sheet pressures are respectively regulated by pressure regulators 103 and 101 to maintain the core sheet pressure at a level sufficiently greater than the face sheet pressure, to ensure that core sheet 91 does not adhere to core sheet 93. Die 111 is heated to a temperature sufficient to cause core sheets 91 and 93 to deflect, yet below the temperature at which the core sheets would diffusion bond together. After a suitable interval, due to the differential between the core sheet pressure and the face sheet pressure, core sheets 91 and 93 begin to separate.

Since the foregoing temperature is below the superplastic forming temperature and the forming pressure is at a relatively low level, sheets 91 and 93 separate only slightly, after which no further strain can occur at this temperature and pressure differential. This interim condition is signaled when the gas mass flow rate measured by gas mass flow meter 109 drops to zero The die temperature is subsequently raised to 1500° F., the core sheet pressure is increased to 75 psig, and the face sheet pressure is increased to 50 psig. As the temperature and core and face sheet pressures are being increased, face sheets 87 and 89 expand against the interior walls of forming die 111. This expansion occurs in a relatively short period. FIG. 9 is a fragmented section view of die 111 showing the position of face sheets 87 and 89 and core sheets 91 and 93, at this stage of the forming process.

The argon gas in cavity 114 is exhausted through exhaust ports 112 and 113. Though not illustrated, the exhausted gas could be vented through a beaker of water using exhaust gas lines, as described in conjunction with apparatus 49 of the present invention. Such a configuration would prevent oxygen from entering cavity 114 and possibly oxidizing face sheets 87 and 89.

The die temperature is subsequently increased to a final value of 1650° F. and the core sheet pressure eventually reaches a final value of 200 psig. This increase in the core sheet pressure advances the forming of cells 125. The nomograph of the present invention is used to determine the optimal gas mass flow rate to complete the superplastic forming of cells 125 from the interim point when the forming temperature is increased from 1500° F. and the core sheet pressure is increased from 75 psig, that is, from when the forming of cells 125 is begun.

The forming process of the prior art is controlled by a relationship between forming pressure and time and, in order for that relationship to provide an accurate result, superplastic forming can start only after the final die temperature has been reached. the present invention saves time over the prior art because the superplastic forming of the present invention starts at an interim point before the higher, final value for the die temperature is reached.

Furthermore, in contradistinction to the prior art, the sheet thickness, alloy composition, or changes in the forming temperature will not affect the reliability of the present invention so long as the die temperature and forming pressure are sufficient to cause the sheet or sheets to superplastically form. Moreover, the present invention can be inexpensively implemented simply by inserting a gas mass flow meter into the input line of a prior art apparatus.

FIGS. 10A, 10B, 10C, and 10D compose a nomograph of the present invention. It is identical to that shown in FIGS. 5A, 5B, 5C, and 5D, but with lines added to explain its use in conjunction with the superplastic forming of the more complex structure of the present example. Using empirical knowledge familiar to those skilled in the superplastic forming art, the volume of core space 118 was determined to increase from 0 to 100 cubic inches when the die temperature was 1500° F. and the core sheet pressure was 75 psig. The volume of the completely formed multiple panel structure was determined to be 1000 cubic inches at a final core pressure of 200 psig.

Figures 10A, 10B:
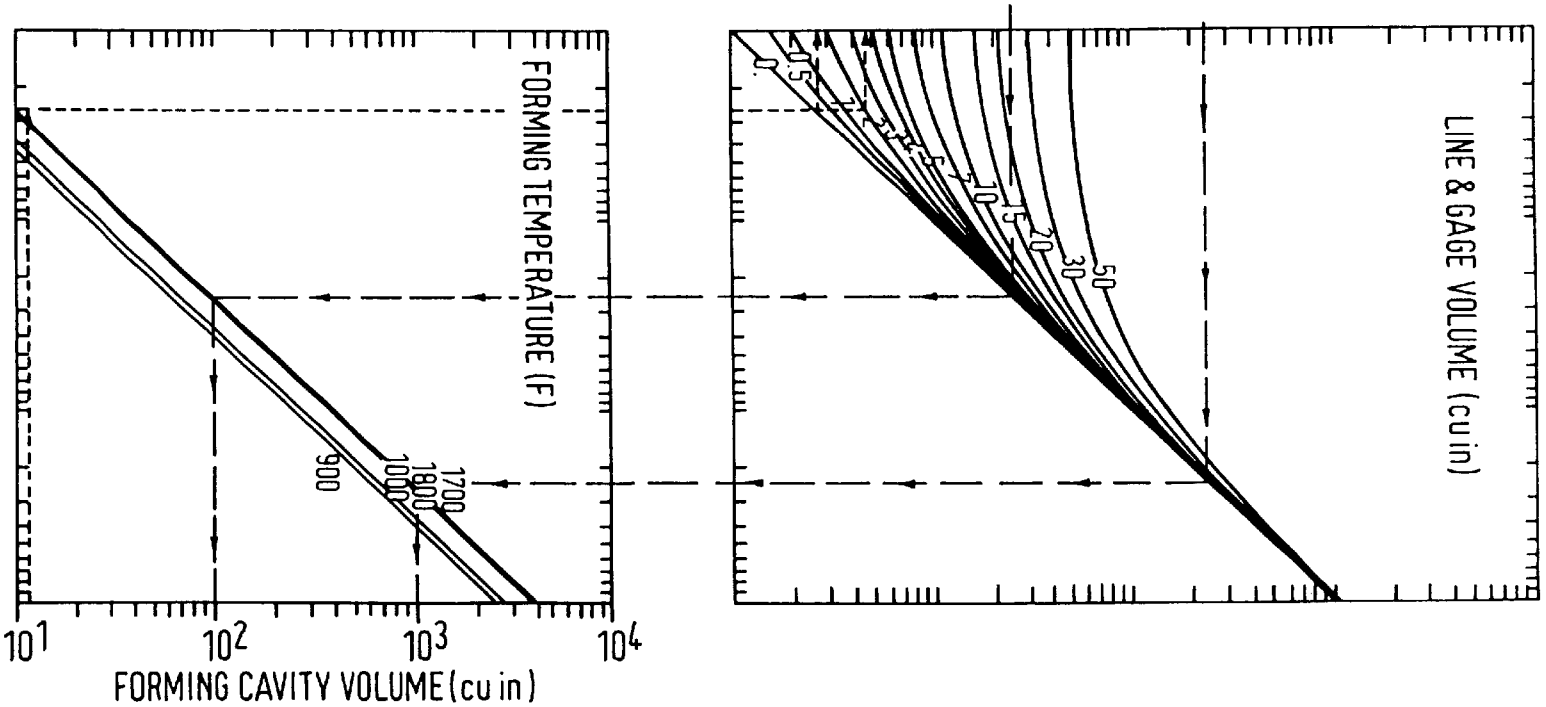
FIGS. 10A, 10B, 10C, and 10D are four interrelated graphs composing a nomograph from which the gas mass flow rate of the present invention can be determined, and also including lines used in conjunction with an example illustrating the use of the apparatus of FIG. 7 to superplastically form cells of multiple sheet panels from a stack of four sheets.

The forming cavity volumes of 100 and 1000 cubic inches are found on the vertical scale of FIG. 10A, and horizontal lines drawn therefrom until they respectively intersect the diagonal forming temperature lines of 1500° F. and 1650° F. Vertical lines from these two intersections in FIG. 10A are extended upward into the graph of FIG. 10B, until they intersect the curved line representing the line and gage volume for core space 118. The foregoing volume is equal to the volume contained by gas line 99 between gas mass flow meter 109 and core port 119, including pressure gage 107. The line and gage volume for core space 118 is low enough relative to the forming cavity volumes to be approximated by zero.

Figures 10C, 10D:
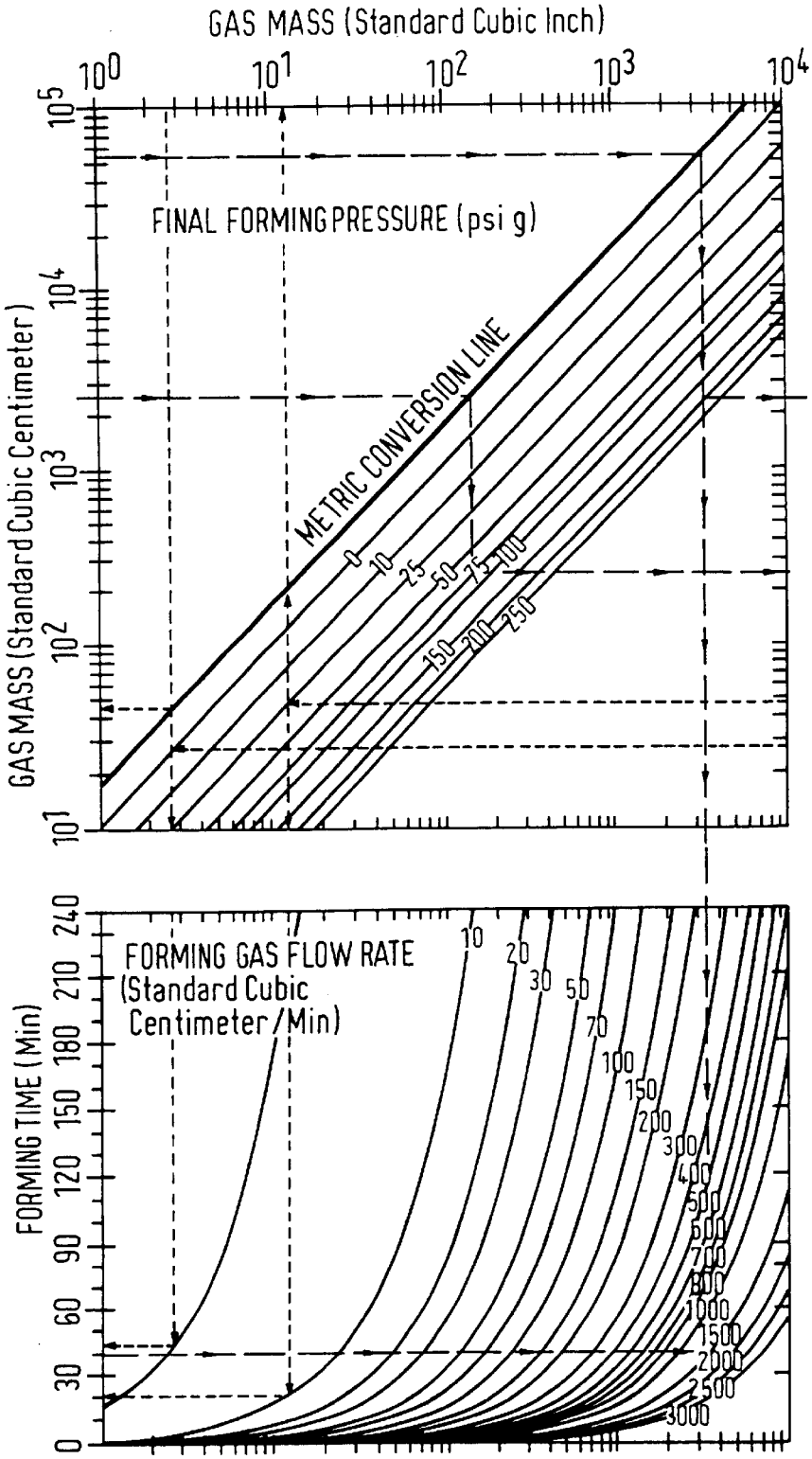

From the two intersections in FIG. 10B, horizontal lines are extended into the graph of FIG. 10C until they respectively intersect the diagonal lines representing the final forming pressures of 75 psig and 200 psig. Vertical lines are then extended upward from the two intersection points until they intersect the diagonal metric conversion line. Horizontal lines are extended form the foregoing intersections to the vertical scale. The values for gas mass are 2700 and 60,100 standard cubic centimeters (scc), respectively. They are, respectively, the gas mass in core space 118 when cells 125 start forming, that is, just after the die temperature is raised from 1500° F. and the core sheet pressure is raised from 75 psig; and the gas mass in cells 125 at the completion of forming.

2700 scc is then subtracted from 60,100 scc for a remainder of 57,400 scc. This value is the gas mass necessary to complete the formation of cells 125 from the interim point at which the die temperature is raised from 1500° F. and the core sheet pressure is increased from 75 psig.

It is estimated that it will take 40 minutes to complete the forming of cells 125 from the aforementioned interim point. The gas mass flow rate required to complete the forming during this period is calculated by dividing 57,400 scc by 40 minutes for a quotient of 1435 scc/min. Alternatively, a graphical solution may be obtained by finding the gas mass of 57,400 on the vertical scale of FIG. 10C, extending a horizontal line until it intersects the metric conversion line, and then extending a vertical line downward into the graph of FIG. 10D. In FIG. 10D, a horizontal line extended from the forming time of 40 minutes intersects the vertical line from FIG. 10C at approximately 1450 scc/min.

As exemplified by FIG. 6, a graph requiring only two input parameters may also be derived and used to approximate the target gas mass flow rate necessary to complete the forming of cells of multiple sheet panels from stacked multiple sheets. Such a simplified graph of the present invention could be derived using the final forming pressure, and by assuming a negligible line and gage volume and a final forming temperature of 1650° F.±50° F. In reference to the foregoing example and to the graph of FIG. 6, the "volume of forming cavity" is equal to 900 cubic inches: the difference between 1000 cubic inches, the volume of completely formed cells 125; and 100 cubic inches, the volume of core space 118 at the interim point. The forming of time is 40 minutes, the time estimated as being necessary to complete the forming of cells 125 from the interim point.

Pressure regulator 103 is used to maintain the desired gas mass flow rate, as measured by gas mass flow meter 109, for the 40 minute completion period. Pressure regulator 103 may be manually adjusted in conjunction with monitoring gas mass flow meter 109, or automatically adjusted using a feedback loop as indicated in FIG. 7, using a target gas mass flow rate obtained from the nomographs of FIGS. 10A–10D.

Figure 12:
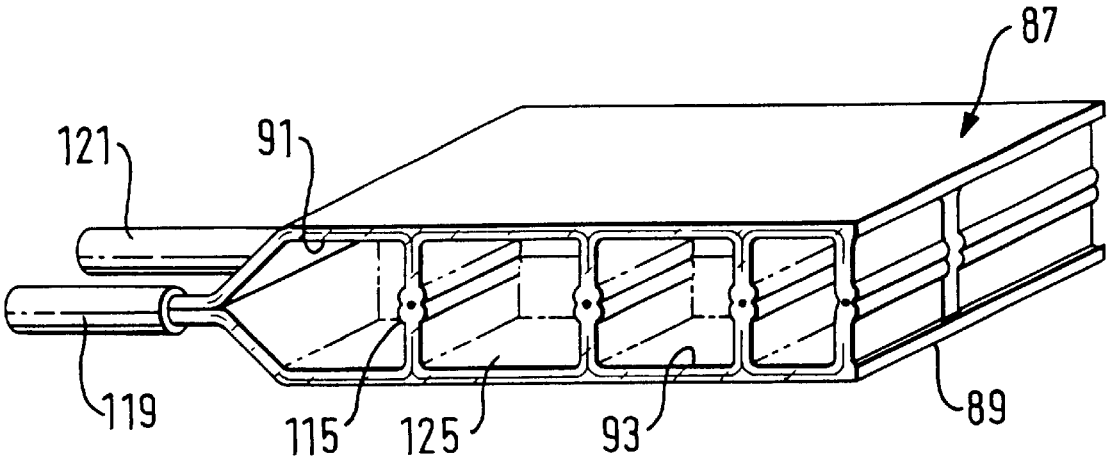
FIG. 12 is a perspective view of the cells formed by the apparatus of FIG. 7.

FIG. 11 is a fragmented sectional view of completely formed cells 125. FIG. 12 is a perspective view of completely formed cells 125.

Although presently preferred embodiments of the invention have been described in detail hereinabove, it should be clearly understood that many variations and/or modifications of the basic inventive concepts taught herein which may appear to those skilled in the pertinent art will still fall within the spirit and scope of the present invention as defined in the appended claims.

What is claimed is:

1. A method for controlling the superplastic forming of at least one metal sheet into an object having a shape, comprising the steps of:

positioning at least one metal sheet in a forming die;

providing means for fluidly communicating a forming gas into the forming die at an actual gas mass flow rate;

providing means for regulating the actual gas mass flow rate;

providing means for measuring the actual gas mass flow rate;

providing means for determining a target gas mass flow rate for the actual mass flow rate;

providing means for comparing the actual gas mass flow rate with the determined target gas mass flow rate;

creating a forming pressure in the forming die by fluidly communicating forming gas into the forming die, so as to provide a differential pressure across the said metal sheet effective to deform the sheet;

comparing the actual gas mass flow rate with the determined target gas mass flow rate; and adjusting the actual gas mass flow rate at the regulating means effective to minimize the difference between the actual gas mass flow rate and the target gas mass flow rate, to control the deforming of the sheet, wherein the comparing and adjusting steps effect a feedback loop including said comparing means and said adjusting means.

2. The method of claim 1, wherein the comparing step comprises generating a signal that is a function of the difference between the actual and target gas mass flow rates, wherein the signal is transmitted to said regulating means, and said regulating means responsive to the signal to effect said adjusting.

3. The method of claim 1, wherein said measuring means is a gas flow meter.

4. The method of claim 1, further comprising, before said creating step, determining a total gas mass that will flow into the forming die during the forming of the object, and estimating a forming time necessary for the forming of the object, and determining said target gas mass flow rate by dividing the determined total gas mass by the determined forming time.

5. The method of claim 1, and wherein said comparing means is capable of continuously comparing the actual gas mass flow rate with the determined target gas mass flow rate.

6. The method of claim 1, wherein the forming pressure is 100 psi to 1000 psi.

7. A method of controlling a superplastic forming apparatus, which forms at least one metal sheet into an object having a shape, said apparatus including a forming die which receives at least one metal sheet, means for fluidly communicating a forming gas into the forming die at an actual gas mass flow rate, means for regulating the actual gas mass flow rate, means for measuring the actual gas mass flow rate, means for determining a target gas mass flow rate for the actual mass flow rate, means for comparing the actual gas mass flow rate with the determined target gas mass flow rate, wherein a said comparing means and said adjusting means comprise a feedback loop, said method comprising:

creating a forming pressure in the forming die by fluidly communicating forming gas into the forming die, so as to provide a differential pressure across the said metal sheet effective to deform the sheet;

comparing the actual gas mass flow rate with the determined target gas mass flow rate; and adjusting the actual gas mass flow rate at the regulating means effective to minimize the difference between the actual gas mass flow rate and the target gas mass flow rate, to control the deforming of the sheet.

8. The method of claim 7, wherein the comparing step comprises generating a signal that is a function of the difference between the actual and target gas mass flow rates, wherein the signal is transmitted to said regulating means, and said regulating means responsive to the signal to effect said adjusting.

9. The method of claim 7, wherein said measuring means is a gas flow meter.

10. The method of claim 7, further comprising, before said creating step, determining a total gas mass that will flow into the forming die during the forming of the object, and estimating a forming time necessary for the forming of the object, and determining said target gas mass flow rate by dividing the determined total gas mass by the determined forming time.

11. The method of claim 7, wherein said comparing means is capable of continuously comparing the actual gas mass flow rate with the determined target gas mass flow rate.

12. The method of claim 7, wherein the forming pressure is 100 psi to 1000 psi.

* * * * *